US010065791B1

(12) United States Patent
Charles

(10) Patent No.: US 10,065,791 B1
(45) Date of Patent: Sep. 4, 2018

(54) AEROSOL APPLICATOR SYSTEM HAVING USER CONFIGURABLE SPRAY DIRECTION

(71) Applicant: Jeffrey B. Charles, Wellington, FL (US)

(72) Inventor: Jeffrey B. Charles, Wellington, FL (US)

( * ) Notice: Subject to any disclaimer, the term of this patent is extended or adjusted under 35 U.S.C. 154(b) by 0 days.

(21) Appl. No.: 15/728,262

(22) Filed: Oct. 9, 2017

(51) Int. Cl.

| | |
|---|---|
| ***B65D 83/30*** | (2006.01) |
| ***B65D 83/20*** | (2006.01) |
| ***B65D 83/14*** | (2006.01) |
| ***B05B 11/00*** | (2006.01) |
| *A45D 34/04* | (2006.01) |

(52) U.S. Cl.
CPC ..... *B65D 83/306* (2013.01); *B05B 11/0091* (2013.01); *B05B 11/3057* (2013.01); *B65D 83/20* (2013.01); *B65D 83/752* (2013.01); *A45D 34/04* (2013.01); *A45D 2200/057* (2013.01); *A45D 2200/1081* (2013.01)

(58) Field of Classification Search
CPC ..... B05B 11/0091; B05B 11/3057; B65D 83/303; B65D 83/306; B65D 83/20; B65D 83/752; A45D 34/04; A45D 2200/057; A45D 2200/1081
USPC ..... 222/380, 460–462, 526–537, 566–567, 222/74–75, 402.1–402.25
See application file for complete search history.

(56) References Cited

U.S. PATENT DOCUMENTS

| | | | | | |
|---|---|---|---|---|---|
| 865,355 | A * | 9/1907 | Callman et al. | B05B 15/066 | 239/588 |
| 1,296,045 | A * | 3/1919 | Campbell | B65D 25/48 | 138/136 |
| 2,704,556 | A * | 3/1955 | Blish | F16L 11/081 | 137/155 |
| 2,998,028 | A * | 8/1961 | Rohde | F16L 11/121 | 138/109 |
| 4,327,775 | A * | 5/1982 | Tally | B60H 1/00571 | 138/103 |
| 4,966,202 | A * | 10/1990 | Bryan | F16L 11/12 | 138/103 |
| 4,966,741 | A * | 10/1990 | Rush | B29C 53/083 | 138/103 |
| 5,240,339 | A | 8/1993 | DeForest et al. | | |
| 5,263,646 | A * | 11/1993 | McCauley | B05B 15/066 | 138/DIG. 8 |
| 5,335,855 | A * | 8/1994 | Borod | A47K 3/26 | 239/152 |
| 5,387,200 | A | 2/1995 | Kronstadt | | |
| 5,529,226 | A * | 6/1996 | Alberth, Jr. | B65D 83/303 | 222/402.1 |

(Continued)

*Primary Examiner* — Nicholas J Weiss
*Assistant Examiner* — Andrew P Bainbridge
(74) *Attorney, Agent, or Firm* — The Concept Law Group, P.A.; Scott M. Garrett

(57) ABSTRACT

An aerosol applicator system include a flexible tube that can be operably coupled to the valve of an aerosol container either directly onto a valve stem, or a valve actuator which is retained on the valve stem. The tube has one or more wires that run along the length the tube and which hold the tube in whatever shape it is configured by a user. The wire or wires are malleable and are disposed in the wall of the tube. A nozzle can be disposed at the terminal end of the tube to atomize the material being propelled out of the aerosol container into droplets of a desired size range.

20 Claims, 7 Drawing Sheets

(56) References Cited

U.S. PATENT DOCUMENTS 5,788,702 A * 8/1998 Draenert ..... A61B 17/8811 222/527
5,851,077 A * 12/1998 Trejo ..... A45D 34/041 401/6
6,105,620 A * 8/2000 Haberl ..... F16L 11/20 138/103
6,269,821 B1 8/2001 Berke et al.
6,412,997 B2 * 7/2002 Berke ..... A45D 34/04 401/138
6,632,195 B1 10/2003 Smith
6,783,037 B1 * 8/2004 Bonham ..... B65D 83/303 222/402.1
7,044,338 B2 * 5/2006 Roden ..... B65D 83/303 222/153.11
7,100,238 B2 * 9/2006 McCauley ..... A46B 5/0062 15/144.1
7,387,222 B2 * 6/2008 Thompson ..... B05C 17/00516 138/118
8,561,850 B1 * 10/2013 Dawson ..... B05C 17/00503 222/191
8,672,931 B2 * 3/2014 Goldboss ..... A61B 18/0218 606/22
8,690,024 B2 * 4/2014 Sogaro ..... A61M 15/0021 222/402.1
8,882,379 B2 11/2014 Jackson
2004/0245208 A1 12/2004 Dennison
2005/0017088 A1 * 1/2005 Denton ..... A61M 11/02 239/333
2008/0135649 A1 * 6/2008 Smyth ..... B65D 83/303 239/588
2011/0240771 A1 * 10/2011 Legeza ..... B05B 15/066 239/588
2013/0193240 A1 * 8/2013 Mason ..... B65D 83/303 239/589
2016/0143821 A1 * 5/2016 Chang ..... B65D 83/32 222/1
2016/0194140 A1 * 7/2016 Sell ..... B65D 83/22 222/153.11
2016/0221744 A1 * 8/2016 Coppus ..... B65D 83/303
2017/0028201 A1 * 2/2017 Howard ..... A61N 1/0553

* cited by examiner

AEROSOL APPLICATOR SYSTEM HAVING USER CONFIGURABLE SPRAY DIRECTION

FIELD OF THE INVENTION

The present invention relates generally to aerosol containers and, more particularly, relates to an aerosol applicator system that allows a person to direct an aerosol propelled material in different directions relative to the aerosol container, including onto portions of the user's body that are generally difficult to reach.

BACKGROUND OF THE INVENTION

There are numerous products that use an aerosol system to apply and/or deliver materials by spray. Aerosol systems generally use one of two methods for propelling the material being sprayed. Both methods use an inert gas under pressure to propel the material out of an aerosol container. The aerosol container can either contain a pressurized material in the aerosol container with the material to be sprayed, and which does not chemically interact with the material to be sprayed, or it can be pumped by the user, where a pump system allows the user to pump air into the aerosol container to create pressure that propels the material out of the container.

Of the materials that are sprayed and delivered out of aerosol containers, some are intended to be applied topically to humans. Examples of such materials include sunscreen, insect repellant, artificial tanner/bronzer, and so on. An issue can arise, however, when a person is alone, or otherwise without help from another person to apply the material to regions of their body that are hard to reach, when using conventional aerosol canisters that direct spray in only one fixed direction, which is away from the canister. This is particularly common with sunscreen, where a person wishes to apply sunscreen to, for example, their own back.

Aerosol sunscreen (or sometimes called "sunblock") containers are very popular because they allow an easy means of applying sunscreen without having to get lotion all over one's hands, among other problems. However, a conventional aerosol container dispenses in a fixed direction away from the container. Furthermore, an aerosol container must be held substantially upright in order for the material inside to be propelled out, due to the internal design of the uptake tube. This makes it awkward, if not impossible, for a person to hold a conventional aerosol sunscreen container and spray sunscreen on their back. In addition to personal uses for spraying topical material such as sunscreen, there are numerous other applications where an aerosol spray to deliver or apply material is desirable, but where the fixed directional spray of conventional aerosol containers does not allow for the easy application of spray to a desired place.

This problem has been address in the past by using, for example, an applicator with a long handle that allows a person to reach their back and apply sunscreen. However this approach has not been popular because dirt and sand tend to stick to the applicator, making subsequent uses uncomfortable as the dirt/sand/debris grind into the user's skin. In addition, sunscreen will only be applied where the applicator actually touches, which is a disadvantage compared to aerosol applications because the spray reaches a wide area.

Therefore, a need exists to overcome the problems with the prior art as discussed above.

SUMMARY OF THE INVENTION

The invention provides a personal aerosol application system that overcomes the hereinafore-mentioned disadvantages of the heretofore-known devices and methods of this general type and that provides an extended tube that can be configured into virtually any shape necessary by a user to allow the user to apply aerosol propelled material onto or into hard to reach places that cannot be accomplished with typical aerosol spray systems that have a fixed direction or spray.

With the foregoing and other objects in view, there is provided, in accordance with embodiments of the invention, an aerosol applicator system for self-application of sunscreen includes a canister in which is disposed the sunscreen and an aerosol propellant under pressure. The aerosol applicator system further includes a valve disposed in a top portion of the canister which opens upon being pressed to allow the sunscreen to be propelled out of the canister by the propellant through a valve stem that extends from the valve. The aerosol applicators system further include a valve actuator mechanically coupled to the valve, and a flexible shape-holding tube having a tube wall with a bore therein. The tube has a first end configured to be coupled to the valve actuator. The tube wall includes at least one wire disposed in the wall of the tube and which retains the tube in a shape upon being configured into the shape by a user.

In accordance with another feature, some embodiments include a nozzle coupled at a second end of the flexible shape-holding tube that atomizes material being propelled out of the canister, through the tube, into a direction determined by how the tube is bent or configured.

In accordance with a further feature of the present invention, some embodiments include the nozzle having a conic bell for directing the atomized material being propelled out of the canister through the tube.

In accordance with a further feature of the present invention, in some embodiments the wire in the tube is wound around the bore of the tube inside the wall of the tube in a helical manner along the length of the tube.

In accordance with a further feature of the present invention, in some embodiments the at least one wires comprises two or more wires along the length of the tube.

In accordance with a further feature of the present invention, in some embodiments the valve actuator includes, or it part of a pump assembly that allows a user to pump air into the aerosol canister or container to propel the material in the container out through the valve and tube.

In accordance with some embodiments the invention can be arranged as a nozzle assembly for use with aerosol containers that includes a valve actuator configured to be mechanically coupled to a valve stem of an aerosol container and having exit formed in the valve actuator to allow material to exit the aerosol container. The nozzle assembly can further include a tube having a tube wall with a bore therein, and having a first end coupled to the valve actuator at the exit. The tube wall including at least one wire disposed in the sidewall of the tube and which retains the tube in a shape upon being configured into the shape by a user. The nozzle assembly can further include a nozzle coupled to a second end of the tube, opposite the first end, having an exit that allows material to pass from the tube out of the nozzle, thereby forming the material into droplets of a selected size range.

In accordance with some embodiments of the invention, there is provided a tube assembly for an aerosol container that includes a tube having a tube wall with a bore therein, and having a first end configured to be operably coupled to a valve stem of the aerosol container. The tube assembly further includes at least one wire disposed in the wall of the tube along a length of the tube and which retains the tube in a shape upon being configured into the shape by a user. The tube assembly further includes a nozzle attached to a second end of the tube.

In some embodiments of the invention, the valve actuator can include a nozzle to which the tube is attached and retained.

Although the invention is illustrated and described herein as embodied in an aerosol applicator system having a user-configurable spray direction, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction. Those skilled in the art can understand the specific meanings of the above-mentioned terms in the embodiments of the present invention according to the specific circumstances

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
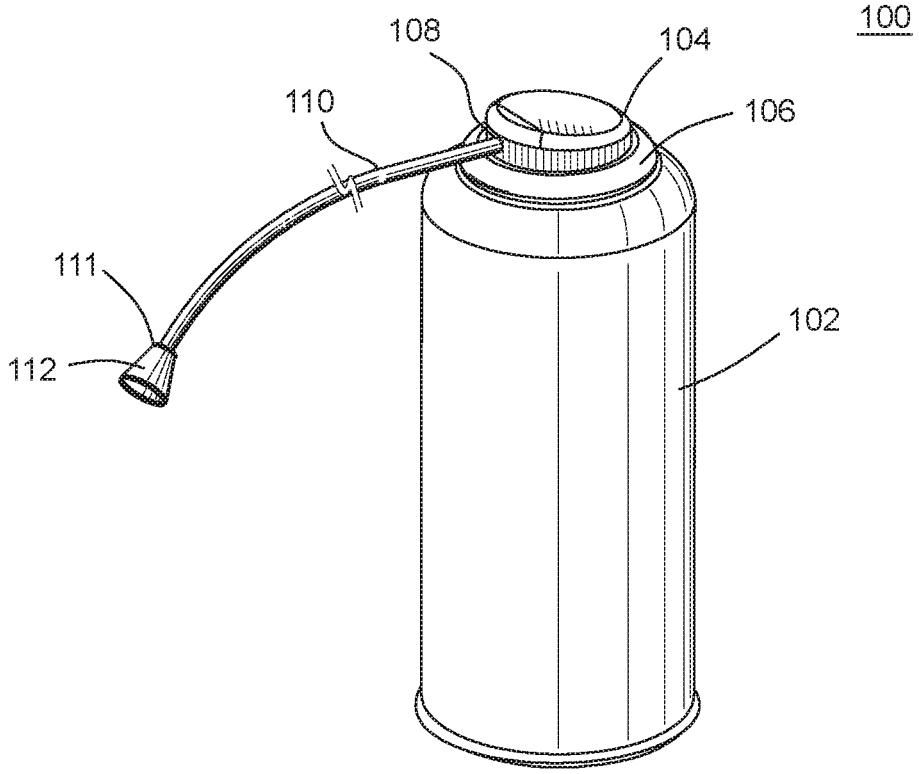
FIG. 1 is a view of an aerosol applicator system for self-application of topical substance, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient aerosol applicator system. Embodiments described and taught herein provide a user-configurable directional aerosol applicator system that allow a user to direct spray from an aerosol container in any selected direction relative to the aerosol container. In addition, embodiments shown and described herein provide a flexible tube that has a shape-holding ability so that it stays in whatever shape is it configured by a user, allow the user to select a desirable direction of spray without having to, for example, invert the aerosol container, or otherwise awkwardly hold the aerosol container in order to apply the spray onto a desired location. In particular, some embodiments can include an aerosol applicator system for self-application of sunscreen that includes a canister in which is disposed the sunscreen and an aerosol propellant under pressure, a valve disposed in a top portion of the canister which opens upon being pressed to allow the sunscreen to be propelled out of the canister by the propellant through a valve stem that extends from the valve, a valve actuator mechanically coupled to the valve stem and having a top and a side with an exit formed in the side, and an insert trough formed around the exit. The aerosol applicator system can further include a tube having a tube wall with a bore therein, and having a first end configured to be inserted and retained in the insert trough, with the tube wall including at least one wire disposed in the wall of the tube which retains the tube in a shape upon being configured into the shape by a user.

Referring now to FIG. 1 there is shown a view of an aerosol applicator system 100 for self-application of topical substance, in accordance with some embodiments. The system 100 includes an aerosol canister 102 in which is disposed the material to be dispensed by the system, such as a sunscreen emulsion, insect repellant, or other material. Generally the aerosol canister 102 includes a propellant, which can be a standard, pressurized propellant, or air that is pumped into the canister by the user. For the purposes of a non-limiting example, it can be assumed that the canister 102 in FIG. 1 includes a compressed propellant and is not pumped. A valve actuator 104 is coupled to a valve stem (not show) which extends up from a top of the canister 102 in a conventional manner, over a top portion 106 of the canister 102. The valve actuator 104 includes a body having a channel that receives, and couples to the valve stem, and forms a passageway to an exit aperture. The valve actuator 104 is manipulated by a user to open/close a valve of the canister 102 that allows material therein to escape out the valve stem. In some embodiments the vale actuator 104 can also be a nozzle device that includes a chamber located between the top of the valve stem and the aperture to allow the material being dispensed and the propellant to swirl and form a mist of propellant and droplets of material. The aperture is generally formed in a side of the nozzle (i.e. not the top). A trough can be formed in the valve actuator around the exit aperture, where the trough is sized to receive and retain an end of a tube 110 upon the tube 110 being fitted therein.

The tube 110 is flexible, but constructed to hold its shape when bent/curved, which allows a user to bend or form the tube in a desired shape, wherein the tube will stay substantially in that shape until formed into a different shape. The tube 110 has a bore to allow the misted material exiting the nozzle to pass through the tube 110 and out a second end 111 of the tube 110. Accordingly, the inner diameter (the bore) of the tube 110 must be sized to allow the material from the canister to pass through it without either losing velocity due to expansion in the tube 110, or aggregating/collecting in the tube 110 which can result in oversized droplets or drops being ejected from the tube in an undesirable manner, which defeats the advantage of an aerosol delivery in providing even coverage in a spray. In some embodiments the tube 110 can have a diameter of two millimeters or less.

In some embodiments, where the valve actuator 104 does not include a nozzle, a nozzle 112 can be retained at the end 111 of the tube 110. The nozzle 112 includes an atomizing passage that causes propellant and material to atomize as it exits the nozzle 112. Furthermore, the nozzle 112 can, in some embodiments, include substantially conic-shaped member to allow some expansion of gas as it exits the nozzle 112, but also to direct the spray coming out of the nozzle 112. In some embodiments the nozzle 112 can have an internal passage construction that ensures a desired misting and droplet size is achieved as the material exits the nozzle 112.

Figure 2:
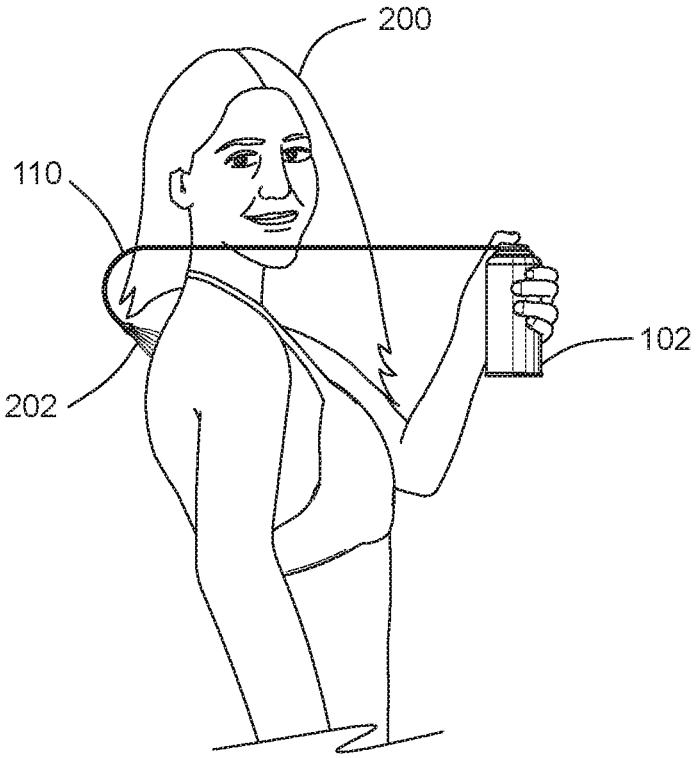
FIG. 2 is a view of a person using an aerosol applicator system for self-applying a substance to a back region of the person, in accordance with some embodiments.

Accordingly, a user can bend the tube 110 in, for example, a generally "U" or "J" shape, among numerous other shapes, so that the nozzle 112 points down, or down and slightly back towards the canister 102, or otherwise in a direction that allows the user to, for example, hold the canister 102 up near their shoulder, with the tube 110 passing over their shoulder so that upon pressing down on the valve actuator 104 the contents of the canister 102 are sprayed onto the user's back. This configuration and usage is illustrated in FIG. 2. The user 200 can use the aerosol delivery system to spray 202 portions of their back, and the user 200 can then move their hand while spraying to cover a larger portion or region of their back. Likewise, the user 200 can hold the canister in other locations to spray on other parts of the user. The user can also bend the tube 110 so that is sprays in substantially the same direction as the valve actuator 104 would spray, to use the aerosol delivery system to spray front portions of their body as well, in a substantially conventional manner.

Figure 3:
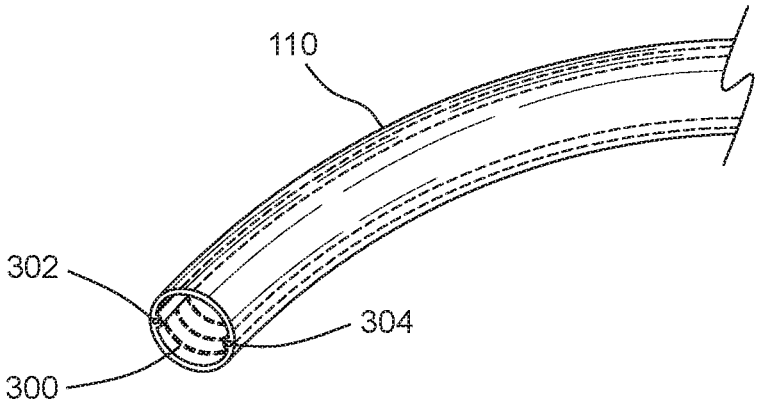
FIG. 3 is a view of a flexible shape-holding tube used in an aerosol delivery system, including a cross-sectional view thereof, in accordance with some embodiments.

FIG. 3 is a view of a flexible shape-holding tube 110 used in an aerosol applicator system, including a cross-sectional view thereof, in accordance with some embodiments. The tube 110 can be substantially similar to that shown in FIGS. 1 & 2. The tube 110 is generally cylindrical with a bore 300 along its length through which material and propellant can pass. The tube 110 is generally made of a flexible compliant material, such as polyvinyl chloride or other related polymers. In some embodiments, the tubing material is selected to discourage adherence of the material being dispensed from the inside of the tube so that aerosolized droplets do not stick together to form drops or larger portions of material.

To hold the tube in shape after being bent by a user, one or more wires are disposed in the wall of the tube. In FIG. 3, one or more wires 302, 304 can used. With two wires, the wires 302, 304 can be arranged opposing each other along the length of the tube wall and captured therein, although in some embodiments the wire or wires may not be coextensive with the entire length of the tube. In some embodiments the inner surface of the tube wall (i.e. in the bore) can protrude into the bore slightly along the length of the wires. The wires 302, 304 are formed of a metal, and are malleable and not tempered as springs. That is, they tend to hold their shape rather than return to an original shape. The wires can be 22-24 gauge, which is approximately 0.51-0.64 millimeters in diameter in some embodiments, but larger or smaller gauge wires can also be used depending on the application, tube wall thickness, pressure of the propellant, and other factors that can affect the ability of the wire(s) to hold the tube in a given shape. In some embodiments, rather than running straight along the tube length, the wires can be twisted around the tube bore. In embodiments where the wire(s) produce a ridge along the inner surface of the tube bore, and the wire(s) twist along the tube length, the resulting spiraling can facilitate swirling of the material passing through the tube to prevent droplets from coalescing into drops, and helping to ensure a mist at the end of the tube.

By providing the wire or wires in the tube wall, a person can bend the tube 110 into different shapes. Specifically, the tube can be bent as shown in FIG. 2, in a general "J" shape, turning the tube 110 at least partly back toward the canister, to allow a user to spray material (such as sunscreen) onto parts of their body that they cannot reach themselves with their hands or with conventional spray cans that only direct spray away from the can.

Figure 4:
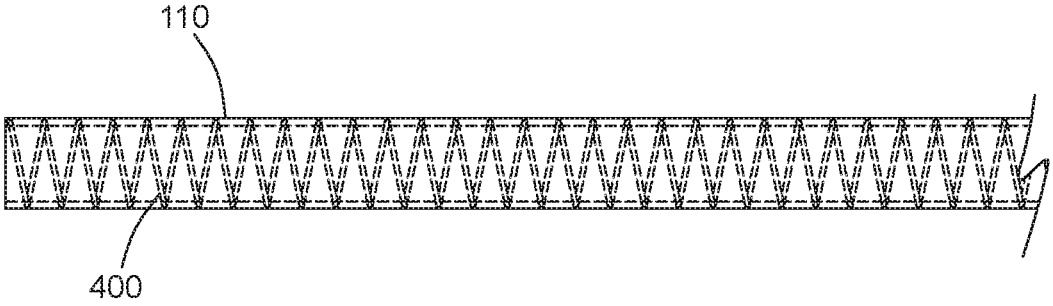
FIG. 4 is a side view of a flexible shape-holding tube used in an aerosol delivery system, in accordance with some embodiments.

FIG. 4 is a side view of a flexible shape-holding tube 110 for use in an aerosol applicator system, in accordance with some embodiments. In the present drawing a helically wound wire 400 is provided in the wall of the tube 110. A helically wound wire can allow the tube 110 to be bent as desired by a user, and hold the tube 110 substantially in that shape thereafter. Furthermore, the stresses experienced by a helically wound wire will be different than that of generally straight wires running along the length of the tube 110, and in some embodiments may be preferred. Like the wires 302, 304, the helically wound wire 400 can be captured in the wall all of the tube 110 (e.g. between the outer and inner surfaces of the tube), rather than being wound around the outside of the tube 110, which protects the wire from exposure to any corrosive substances, oxidation, and so on. Furthermore, by forming the tube with the wire(s) captured in the wall of the tube, a manufacturing step of adding the wire(s) to the tube is obviated.

Figure 5:
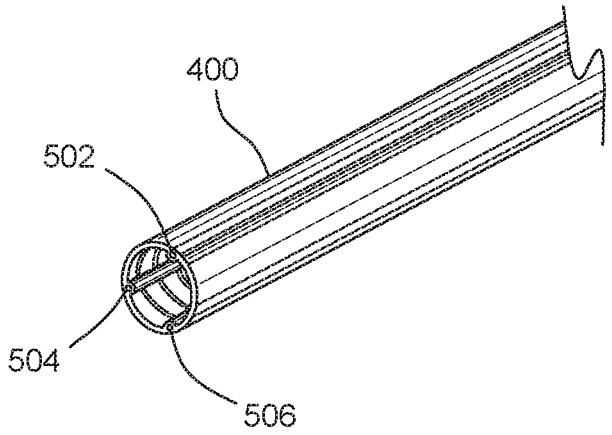
FIG. 5 is a view of a flexible shape-holding tube used in an aerosol delivery system, including a cross-sectional view thereof, in accordance with some embodiments.

FIG. 5 is a view of a flexible shape-holding tube 110 used in an aerosol delivery system, including a cross-sectional view thereof, in accordance with some embodiments. In particular, the tube 110 of FIG. 5 uses three wires 502, 504, 506 along the length of the tube 110. This simply illustrates that more than two wires can be used, in fact more than three wires can be used. Each of the wires 502, 504, 506 are captured in the wall of the tube 110 and the channels in which the wires reside can allow the wires to move/slide therein to relieve tensile stress on the wires upon the tube 110 being bent. In other embodiments the wires 502, 504, 506 can be bonded to the tube wall material. In some embodiments, the wires 502, 504, 506 reside in channels in the wall of the tube 110 and are not bonded to the tube material, and are free to move with their respective channels to allow the wires 502, 504, 506 to slide within the tube wall when the tube 100 is bent.

It will be appreciated by those skilled in the art that various arrangements of wire or wires within a tube wall of a tubes used to dispense an aerosol propelled material in accordance with, and without departing from, embodiments disclosed herein. For example, the wire can be a mesh or screen of wires disposed in the tube wall. Where more than one wire is used the wires can vary in cross sectional diameter, and/or metal composition. In some embodiments, the channel in which the wire or wires are disposed in the wall of the tube can produce corresponding ridges in the tube wall, either inside the tube bore, on the outside surface of the tube, or both. Ridges on the outside of the tube can provide grip to the user when bending the tube. Ridges formed on the interior of the tube, in the bore, that twist around the bore in the axial direction of the bore, can impart a corresponding twist or swirl to the material being propelled through the tube. Furthermore, it will be appreciated that, as used here, the term "bent," referring to shaping of the tube 110 by a user, where the exit end of the tube is not in axial alignment with the entrance end of the tube nearest the canister from the perspective of material flowing out of the canister. Generally, the tube will be bent along a sufficient radius to avoid kinks or other undesirable constrictions in the tube.

Figure 6:
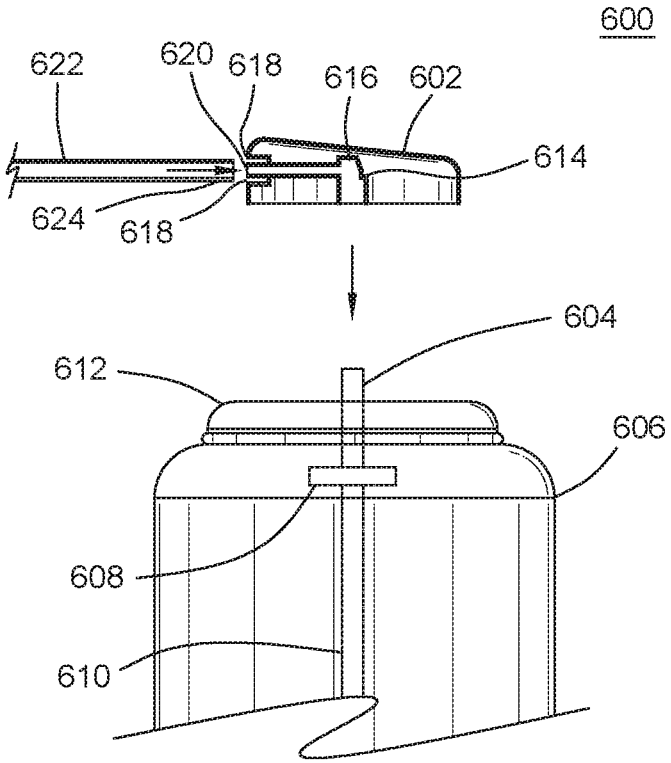
FIG. 6 is a side view including partial cutaway views of a nozzle and valve system for use with an aerosol canister or container, to facilitate self-application of the contents of the canister or container, in accordance with some embodiments.

FIG. 6 is a side view including partial cutaway views of a nozzle and valve system 600 for use with an aerosol canister or container, to facilitate self-application of the contents of the canister or container, in accordance with some embodiments. In particular, the nozzle 602 also acts as a valve actuator to control release of material from an aerosol container. Furthermore, It is contemplated that, in some embodiments, a nozzle 602 can be manufactured so as to be adapted to fit on standard aerosol canisters, and to accept and retain a bendable shape-holding tube 620. In this way, aerosol canisters manufactured without a bendable shape-holding tube (i.e. conventional aerosol containers) can have their conventional nozzle removed by a user a replaced with a nozzle 602 and tube 620 as disclosed.

The nozzle 602 fits onto a valve stem 604 of an aerosol canister 606. The valve stem 604 is connected to a valve 608 inside the aerosol canister 606, and is surrounded by a collar 612 can guide the nozzle 604 as it is depressed to release material from the canister. The valve 608 opens upon the valve stem being pushed downward, relative to the valve 608/canister 606. Material inside the canister 606 is pushed through a down tube 610 by pressure created by a propellant. The propellant is inert with respect to the material being propelled out of the canister. The canister 606 can use a propellant that is under pressure and contained within the canister, or it can be air that is pumped into the canister by the user.

A conventional nozzle configuration includes an internal swirl chamber. Accordingly, the valve stem 604 can fit into a channel in the nozzle 602, and is stopped by a shoulder 614 that interferes with the top of the valve stem to prevent further insertion of the valve stem into the nozzle 602. When so positioned, a swirl chamber 616 is formed directly above the top of the valve stem 604 where the material and propellant exit the valve stem 604. The swirl chamber 616 allows the material to be formed into suitable droplet sizes for the application of the material, and is connected to an exit channel 620. Because the droplet formation occurs under relatively high pressure, it is advantageous to perform droplet formation in the nozzle 604. However, it is contemplated that droplet formation can also occur at the exit (not shown) of the tube 622, as the material and propellant exit the tube 622. The exit channel 620 can be have its outer terminus surrounded by a trough 618 in the side of the nozzle 602 that is sized to accept and retain an end 624 of the tube 622. That is, the tube end 624 can be pushed or pressed into the trough 618 where it will be retained by a mechanical. The trough is one example of a tube retention feature that mechanically secures the tube 622 to the nozzle with a sufficient seal to prevent leakage. Another tube retention feature can be formed by extending a portion of the nozzle through which the channel 620 passes that has a diameter slightly larger than a diameter of the bore of the tube 622 so that the end 624 of the tube 622 can be slid over, and retained by friction, on the extension equivalently. The tube 622 can be constructed in accordance with any of the examples shown or described in conjunction with FIGS. 1-5.

Figure 7:
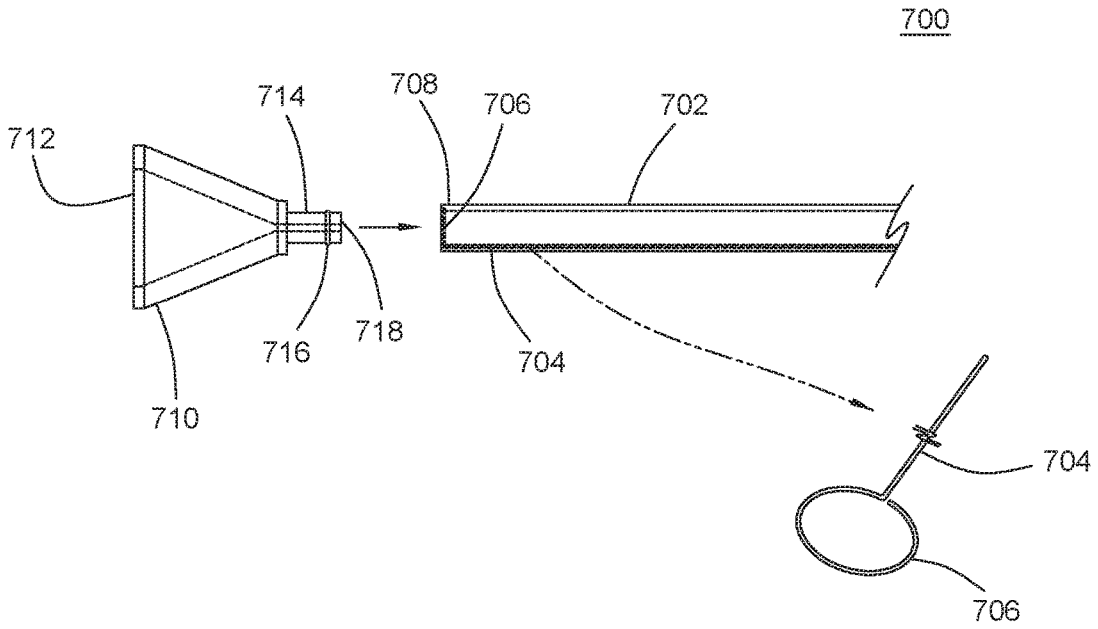
FIG. 7 is a side view of a terminal nozzle for use on a flexible shape-holding tube for use with an aerosol delivery system, in accordance with some embodiments.

FIG. 7 is a side view of a nozzle 710 for use on a flexible shape-holding tube for use with an aerosol delivery system 700, in accordance with some embodiments. The system 700 includes a tube 702 that can be constructed in accordance with any of the examples of tubes shown or described in conjunction with FIGS. 1-5. Generally the tube 702 includes one or more malleable wires elements along a length of the tube 702 which can bend and hold their shape after being bent, thereby retaining the tube 702 in the same shape. The wire elements include at least some wire or wires that are disposed in the wall of the tube 702 along the length of the tube 702. In some embodiments, a wire 704 disposed in the wall of the tube 702 can have a circumferential loop 706 that is disposed at a terminus 708 of the tube 702. The loop 706 goes substantially around the circumference of the bore of the tube 702 at the terminus 708 and provides an interference retention function with a ridge 716 on an insert portion 714 of the nozzle 710. A pathway 718 through the insert portion 714 allows aerosolized material to pass out of the tube 702. The insert portion 714 is inserted into the terminus 708 of the tube 702; specifically into the bore at the terminus 708 of the tube 702. The nozzle 710 can include a directional feature, such as a bell or conic section 712 to direct the aerosolized material being propelled out of the tube 702 through the exit pathway 718. The exit pathway 718 can act as a droplet former, by controlling the diameter of the pathway 718 at its exit point (i.e. farthest form the tube 702) to form droplets in a desired size range. The other end (not shown) of the tube 702 is coupled to a valve actuator to allow a user to control the release of material from the aerosol container.

Figure 8:
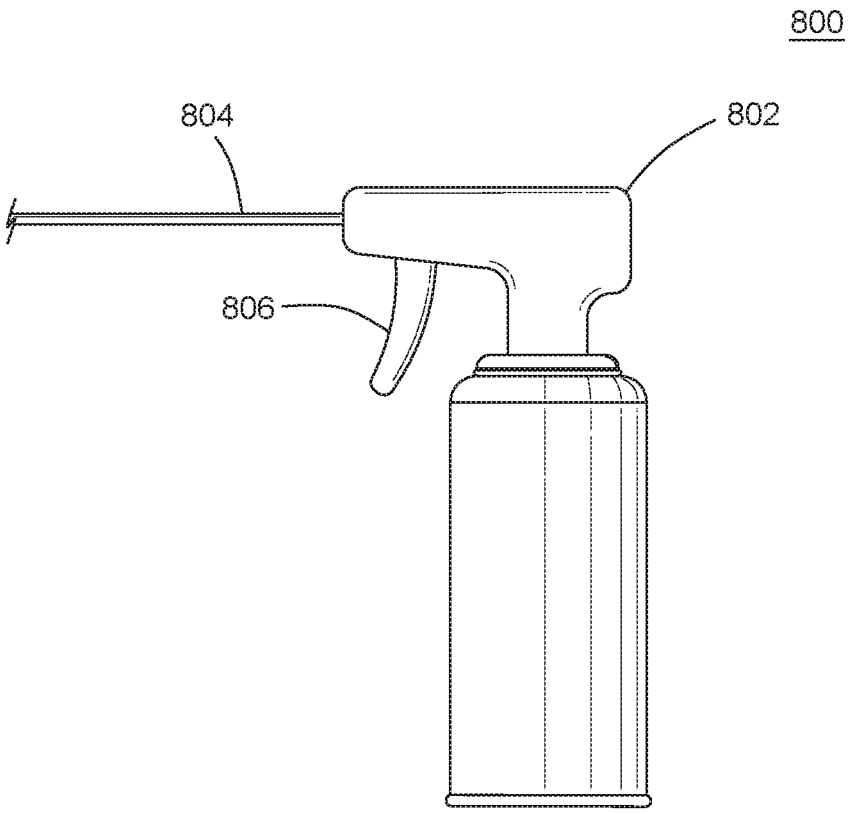
FIG. 8 is a view of a pump aerosol delivery system which pumps air into the container as a propellant, in accordance with some embodiments.

FIG. 8 is a view of a pump aerosol delivery system 800 which pumps air into the container under pressure, as a propellant, in accordance with some embodiments. A pump body 802 generally attaches to a container 803 in which a liquid material is disposed that is to be dispensed. The pump body 802 can be attached and retained on the container 803 by, for example a threaded coupling system, as is conventional. As is well known, a trigger 806 is used to pump air into the container 803 by actuating a pump mechanism, which pressurizes the interior of the container, causing the liquid inside to exit through a downtube connected to the pump body 802 that extends into the container 803. The pump can be considered a valve actuator in such embodiments since actuating the pump controls the release of material from the aerosol container. Generally such pumps have a spay nozzle that sprays material away from the container, outwardly from the pump body 802. However, here, a flexible shape-holding tube 804 is attached to the pump exit. The tube 804 can be substantially constructed in accordance with the tubes shown in FIGS. 1-5, and can include a nozzle at its end, as in FIG. 7, as described in the accompanying disclosure herein. Other such pump arrangements are known, conventionally, that can also be adapted to use a flexible shape-holding tube to allow a user to direct a spray in other directions, including in a direction back towards the container 803.

An aerosol or spray applicator system has been disclosed that includes a flexible shape-holding tube that both extends the reach of the system, and allows a user to direct the spray in different directions as desired by the user. The disclosed system and the various embodiments can be used advantageously by the user to self-apply topical material to their own person on areas of their body that are otherwise difficult or impossible to reach using conventional spray applicators. Likewise, the flexible shape-holding tube can be bent into shapes that allow a user to spray material into hard to reach places, such as, for example, behind objects that are difficult or impossible to move, in blind spots, or other similarly difficult places to reach with conventional spray applicators.

What is claimed is:

1. An aerosol applicator system for self-application of sunscreen, comprising:

a canister in which is disposed the sunscreen and an aerosol propellant under pressure;

a valve disposed in a top portion of the canister which opens upon being pressed to allow the sunscreen to be propelled out of the canister by the propellant through a valve stem that extends from the valve;

a valve actuator mechanically coupled to the valve;

a tube having a tube wall with a bore therein, and having a first end configured to be coupled to the valve actuator, the tube wall including at least one wire disposed in and bonded to the sidewall of the tube and which retains the tube in a shape upon being configured into the shape by a user and wherein a ridge is formed along the at least one wire within the bore or on an outside of the tube; and a nozzle coupled to a second end of the tube opposite the first end;

wherein the at least one wire forms a circumferential loop at the second end of the tube, and wherein the nozzle includes an insert portion that fits within the bore of the tube at the second end of the tube, the insert portion including a ridge that interferes with the circumferential loop to retain the nozzle in the tube.

2. The aerosol applicator system of claim 1, wherein the valve actuator comprises a tube retention formed as a trough in the valve actuator.

3. The aerosol applicator system of claim 1, wherein the nozzle comprises:

a conic portion which extends from the second end of the tube with an increasing diameter; and an attachment portion that mechanically couples to the second end of the tube to retain the nozzle at the second end of the tube.

4. The aerosol applicator system of claim 1, wherein the at least one wire is wound around the tube along its length in a helical manner.

5. The aerosol applicator system of claim 1, wherein the at least one wire comprises two wires disposed on opposing sides of the tube along a length of the tube.

6. The aerosol applicator system of claim 1, wherein the at least one wire comprises at least three wires disposed equidistant from each other around a circumference of the tube and which extend along a length of the tube.

7. The aerosol applicator system of claim 1, wherein the propellant is air, and wherein the valve actuator and valve further comprise a pump which, upon the valve actuator being pressed pumps air into the canister.

8. The aerosol applicator system of claim 1, wherein the tube has an inner diameter of 2 millimeters or less.

9. A nozzle assembly for use with aerosol containers, comprising:

a valve actuator configured to be mechanically coupled to a valve stem of an aerosol container and having exit formed in the valve actuator to allow material to exit the aerosol container;

a tube having a tube wall with a bore therein, and having a first end coupled to the valve actuator at the exit, the tube wall including at least one wire disposed in and bonded to the sidewall of the tube and which retains the tube in a shape upon being configured into the shape by a user, and wherein a ridge is formed within the bore of the tube along the at least one wire; and a nozzle coupled to a second end of the tube, opposite the first end, having an exit that allows material to pass from the tube out of the nozzle, thereby forming the material into droplets of a selected size range;

wherein the at least one wire forms a circumferential loop at the second end of the tube, and wherein the nozzle includes an insert portion that fits within the bore of the tube at the second end of the tube, the insert portion including a ridge that interferes with the circumferential loop to retain the nozzle in the tube.

10. The nozzle assembly of claim 9, wherein the tube has an inner diameter of 2 millimeters or less.

11. The nozzle assembly of claim 9, wherein the nozzle comprises:

a conic portion which extends from the second end of the tube with an increasing diameter; and an attachment portion that mechanically couples to the second end of the tube to retain the second nozzle at the second end of the tube.

12. The nozzle assembly of claim 9, wherein the at least one wire is wound around the tube along its length in a helical configuration.

13. The nozzle assembly of claim 9, wherein the at least one wire comprises two wires disposed on opposing sides of the tube along a length of the tube.

14. The nozzle assembly of claim 9, wherein the at least one wire comprises at least three wires disposed equidistant from each other around a circumference of the tube and which extend along a length of the tube.

15. The nozzle assembly of claim 9, wherein the valve actuator comprises a tube retention formed as a trough in the valve actuator.

16. The nozzle assembly of claim 9, wherein the valve actuator is a pump that allows a user to pump air into the aerosol container, thereby causing material and air inside the aerosol container to enter into the tube under pressure.

17. A tube assembly for an aerosol container, comprising:

a tube having a tube wall with a bore therein, and having a first end configured to be operably coupled to a valve stem of the aerosol container;

at least one wire disposed in the wall of the tube along a length of the tube and which retains the tube in a shape upon being configured into the shape by a user, wherein the at least one wire is formed into a circumferential loop at a second end of the tube; and a nozzle attached to the second end of the tube and having an insert portion that fits within the bore of the tube at the second end of the tube, the insert portion including a ridge that interferes with the circumferential loop to retain the nozzle in the tube.

18. The tube assembly of claim 17, wherein the at least one wire is wound helically along a length of the tube.

19. The tube assembly of claim 17, wherein the nozzle comprises a conic portion.

20. The tube assembly of claim 17, wherein the tube has a maximum bore diameter of 2 millimeters.

* * * * *